US010890051B2

(12) United States Patent
Daasvatn

(10) Patent No.: US 10,890,051 B2
(45) Date of Patent: Jan. 12, 2021

(54) HANDLING HEAVY SUBSEA STRUCTURES

(71) Applicant: Subsea 7 Norway AS, Stavanger (NO)

(72) Inventor: Sigbjorn Daasvatn, Hornnes (NO)

(73) Assignee: Subsea 7 Norway AS, Stavanger (NO)

( * ) Notice: Subject to any disclaimer, the term of this patent is extended or adjusted under 35 U.S.C. 154(b) by 0 days.

(21) Appl. No.: 16/595,434

(22) Filed: Oct. 7, 2019

(65) Prior Publication Data

US 2020/0040706 A1 Feb. 6, 2020

Related U.S. Application Data

(62) Division of application No. 15/524,267, filed as application No. PCT/EP2015/075863 on Nov. 5, 2015, now Pat. No. 10,435,991.

(30) Foreign Application Priority Data

Nov. 5, 2014 (GB) ..... 1419709.9

(51) Int. Cl.

| | |
|---|---|
| ***E21B 40/00*** | (2006.01) |
| ***E21B 41/00*** | (2006.01) |
| ***E21B 43/017*** | (2006.01) |
| ***E21B 43/36*** | (2006.01) |
| ***E21B 19/00*** | (2006.01) |
| ***B63B 21/66*** | (2006.01) |
| *E21B 43/01* | (2006.01) |

(52) U.S. Cl.

CPC ..... *E21B 41/0007* (2013.01); *B63B 21/66* (2013.01); *E21B 19/002* (2013.01); *E21B 43/017* (2013.01); *E21B 43/36* (2013.01); *E21B 43/0107* (2013.01)

(58) Field of Classification Search

CPC combination set(s) only.
See application file for complete search history.

(56) References Cited

U.S. PATENT DOCUMENTS

| | | | |
|---|---|---|---|
| 3,368,515 | A | 2/1968 | Endo et al. |
| 3,713,411 | A | 1/1973 | Bordessoule et al. |

(Continued)

FOREIGN PATENT DOCUMENTS

| | | |
|---|---|---|
| CA | 1042673 | 11/1978 |
| EP | 0 069 446 | 1/1983 |

(Continued)

OTHER PUBLICATIONS

Den Boer, A.S. et al., "An Integrated Towed Flowline Bundle Production System for Subsea Developments," OCT-6430-MS, Offshore Technology Conference, May 10, 1990, Houston, Texas.

*Primary Examiner* — Kyle Armstrong
(74) *Attorney, Agent, or Firm* — Levy & Grandinetti

(57) ABSTRACT

A method transports and installs a heavy subsea structure such as a subsea processing center for produced crude oil or natural gas. The method includes controlledly flooding at least one ballast tank attached to or incorporated into the structure to the extent that the structure becomes negatively buoyant at a pre-determined towing depth. The method also includes towing the negatively-buoyant structure at the towing depth by the Controlled Depth Towing Method (CDTM). After towing to the installation location, the method includes further flooding the ballast tank to lower the structure onto the seabed. At the seabed, a fluid transportation pipe of a subsea production installation may be coupled to pipework of the structure.

8 Claims, 9 Drawing Sheets

(56) References Cited

U.S. PATENT DOCUMENTS

| | | | |
|---|---|---|---|
| 3,987,638 | A | 10/1976 | Burkhardt et al. |
| 4,015,553 | A | 4/1977 | Middleton |
| 4,108,101 | A | 8/1978 | Schirtzinger |
| 4,120,362 | A | 10/1978 | Chateau et al. |
| 4,192,383 | A | 3/1980 | Kirkland et al. |
| 4,350,111 | A | 9/1982 | Boyce, II |
| 4,625,805 | A | 12/1986 | Ladecky |
| 4,784,527 | A | 11/1988 | Hunter et al. |
| 5,215,410 | A | 6/1993 | Karal |
| 8,141,643 | B2 | 3/2012 | Fowkes |
| 2005/0152748 | A1 | 7/2005 | Tangen et al. |
| 2006/0118310 | A1 | 6/2006 | Euphemio et al. |
| 2011/0206465 | A1 | 8/2011 | Howard et al. |
| 2012/0275865 | A1 | 11/2012 | Hayman |

FOREIGN PATENT DOCUMENTS

| | | |
|---|---|---|
| EP | 0 260 143 | 3/1988 |
| GB | 2 205 123 | 11/1988 |
| GB | 2 277 949 | 11/1994 |
| GB | 2 279 098 | 12/1994 |
| GB | 2 457 784 | 9/2009 |
| GB | 2 464 714 | 4/2010 |
| GB | 2 509 165 | 6/2014 |
| WO | WO 01/71158 | 9/2001 |
| WO | WO 2010/046686 | 4/2010 |
| WO | WO 2010/144187 | 12/2010 |
| WO | WO 2011/037477 | 3/2011 |
| WO | WO 2014/095942 | 6/2014 |
| WO | WO 2014/108631 | 7/2014 |
| WO | WO 2014/130320 | 8/2014 |

HANDLING HEAVY SUBSEA STRUCTURES

This invention relates to the construction, transportation, installation and recovery of heavy subsea structures, particularly subsea processing centres for use in oil and gas field developments.

The invention facilitates the use of subsea processing centres, which are a new generation of submerged offshore units for pre-processing, conditioning or otherwise processing production fluid flowing from subsea wellheads. Such centres are key elements of 'subsea factories' that aim to provide processed production fluid from oil and gas fields with minimal surface processing operations. Indeed, potentially, there need be no surface processing operations at all before the subsea-processed production fluid is ready for onward transportation to its destination.

To put the invention in its proper context, subsea processing centres are to be distinguished from templates, which are designed specifically for supporting and guiding drilling equipment on the seabed. For example, U.S. Pat. No. 4,784,527 describes a lightweight modular drilling template. Templates do not carry permanent oil or gas processing equipment, which equipment typically comprises at least a water separator for removing water from the production fluid. Consequently, whilst templates can be bulky, they are much lighter than subsea processing centres. Subsea processing centres therefore present distinct problems that the present invention seeks specifically to address.

In subsea processing centres, equipment and related piping are packaged and mounted on a common frame to ease installation. Advantageously, grouping the equipment and piping on the same frame in this way also allows pre-testing of the system and its components onshore or in sheltered water, before installation.

Subsea processing centres are examples of large, heavy structures that are used with increasing frequency in subsea installations. The size and weight of such structures is increasing sharply as their required functionality similarly increases. This presents major challenges for transportation and installation.

It is well known for a large subsea structure or the equipment that it supports to be divided into smaller packages that are lifted and lowered individually and coupled on the seabed. Examples of this technique are disclosed in U.S. Pat. No. 4,625,805 and WO 2011/037477. However, a multi-step piece-by-piece construction approach has significant drawbacks. It takes a lot of valuable time, which ties up extremely expensive vessels and requires a prolonged weather window. It also loses the advantage of pre-testing the assembled system before installation and hence risks unreliability.

Multiple lifting operations increase risk and require very accurate positioning each time, thus requiring the use of an installation vessel fitted with a dynamic positioning (DP) system and a sophisticated heave-compensated lifting system. The DP system of such a vessel must be to the highest specification, namely Level III, which requires an emergency back-up DP system in the event that the main DP system is ever disabled.

For these reasons, it may be preferred to install a large subsea structure in a single lowering operation, where that is practical, rather than to install an equivalent structure piece-by-piece in multiple lowering operations.

Traditionally, large subsea structures have been installed at an installation site by lifting them from a surface vessel such as a barge and lowering them into the water with a crane, or by launching them into the water from a surface vessel and then lowering them with a winch. As subsea loads have grown, the mindset of the industry has been to adopt larger cranes and larger winches. However, the capital cost of vessels fitted with such cranes and winches is becoming prohibitive and the global availability of such vessels is a logistical challenge.

Oil and gas resources are being exploited in deeper waters in which not just the weight of the structure but also the weight of very long lifting cables must be taken into account. Yet, the capacity of available cranes and winches remains limited. There is also a limit on the size of structure that available vessels can accommodate. For example, U.S. Pat. No. 8,141,643 teaches the use of a support frame connected to a subsea structure and suspended underneath an installation vessel. The size of the subsea structure remains limited by the size of the vessel: in particular, the width of the subsea structure cannot be much greater than the beam of the vessel.

In view of these challenges, wet towing has been adopted as another approach to the installation of large subsea structures. This involves towing the structure through the water to an installation site and lowering it there to the seabed using a winch or a crane. Towing avoids size and weight restrictions arising from the limited deck space and lifting capacity of available vessels and cranes.

By way of example, a wet towing method known in the art as the Controlled Depth Tow Method or 'CDTM' has been used for the installation of bundled pipelines. It is described in EP 0069446 and also used in WO 2014/095942. The towed pipeline is slightly negatively buoyant at a given water depth but it stabilises at that depth due to drag forces experienced during towing. A significant challenge of this method is the underwater stability of the towed structure, which is addressed by fine management of buoyancy using ballast tanks. In this respect, however, the stability of an elongate structure such as a pipeline is much easier to manage than the stability of a structure that has concentrated weight and buoyancy, such as a subsea processing centre.

Another technique for controlling the stability and/or depth of a subsea structure during towing is the use of adjustable fins, as described in U.S. Pat. No. 3,368,515.

Installation of subsea structures is not the only challenge: dismantling of such structures also has to be taken into account because eventually the structures have to be recovered. For example, recovery of a subsea structure such as a subsea processing centre will be necessary upon decommissioning a field. Also, in a modular approach, a subsea processing centre could be moved from a depleted field to another field for continued processing of production fluids there. As during installation, it is similarly demanding to recover or to move the structure as a whole; or similarly prolonged to recover or to move the structure piece-by-piece.

U.S. Pat. No. 4,120,362 describes a typical multi-purpose subsea frame. It is installed by being suspended from a string of pipes from a drilling rig. This is not relevant for the installation of heavy structures in deep water because a long string of pipes of the requisite strength would be far too heavy.

U.S. Pat. No. 3,987,638 describes a subsea structure designed for installation by a launching and lowering method. Various structural members of the structure define hollow, closed volumes that are used for ballasting. Thus, the closed volumes are initially filled with a gas or air to impart positive buoyancy to the structure so that it floats when launched. Subsequently, the closed volumes are flooded with water to establish negative buoyancy so that the structure can be lowered toward the seabed. GB 2205123 also describes lowering a subsea installation to the seabed by flooding buoyancy tanks provided on the subsea installation.

The main drawback of the ballasting technique described in U.S. Pat. No. 3,987,638 is that structural members that are dimensioned appropriately for their structural duties will not, by themselves, provide sufficient ballast volume to confer positive buoyancy upon a heavy structure. In this respect, U.S. Pat. No. 3,987,638 discloses a drilling template which, as noted above, does not carry permanent oil or gas processing equipment and so is much lighter than a subsea processing centre. Even in that less demanding case, the structural members used for ballasting are much enlarged in relation to their structural duty.

It is well known to those skilled in the art that releasable buoys or deflatable airbags may be attached to a negatively-buoyant structure to achieve positive buoyancy before lowering. Releasing buoys or deflating airbags to reduce buoyancy for lowering adds complexity to the lowering operation and does not facilitate fine control of buoyancy. In addition, once a buoy has been released or an airbag has been deflated, its ballasting effect is lost permanently from that point in the process onwards.

U.S. Pat. No. 3,713,411 discloses a submersible catamaran for transporting a load across water and subsequently lowering that load to the bottom. The submersible catamaran is stated to be suitable for loads of up to five tons in depths of up to fifty metres. It is therefore unsuitable for use in the much deeper waters now being exploited by the oil and gas industry, or for delivering loads as heavy as subsea processing centres that may weigh thousands of tons.

Another known approach is to lower a positively buoyant structure before stabilising it on the seabed. In GB 2277949, for example, a positively buoyant structure is pulled down by wires and anchored to the seabed. This approach has drawbacks including a lack of stability because the anchored structure can still move relative to the seabed. In addition, if an anchoring wire ever ruptured or pulled away from its foundation, the structure could shoot upwards through the water column and potentially strike a vessel on the surface. GB 2464714 also describes lowering a positively buoyant assembly to the seabed, in that case using a weight.

In WO 2010/046686, chain counterweights confer negative buoyancy on a subsea structure such that the weighted structure remains negatively buoyant throughout installation. The counterweights also provide stability on the seabed but can be removed after the installation of additional equipment packages if required.

WO 2014/108631 describes a submersible barge and frame to transport heavy and bulky equipment to an installation site in a surface tow operation and then to lower that equipment to the seabed. The frame comprises a rectangular structure with two lateral ballast tanks and two transverse trusses. A system of winches suspends the frame from buoys for the purpose of stabilisation. There is no suggestion of installing a load as heavy as an all-in-one subsea processing plant. WO 2010/144187 describes a method of transporting and lowering a processing facility to a subsea installation location. The method comprises surface towing the processing facility followed by sinking the processing facility to the seabed. Neither of these documents teaches sub-surface towing or ballast management.

WO 2014/130320 describes a modular transportation and installation system for subsea processing equipment. Equipment modules each carry one or more items of subsea equipment and have individual buoyancy whereby individual modules may be detached from the subsea installation after use and floated to the surface for maintenance or replacement.

On first installation, the modules are tested, towed across the surface to an installation site and then lowered for attachment underwater to a template pre-installed on the seabed. Modules can be attached to each other or to a sub-platform base to form a module assembly before towing. Alternatively, modules can be attached to each other on the pre-installed template when at the seabed.

Surface towing of the modules or module assemblies in WO 2014/130320 is performed within a moonpool of a barge, from which the module or assembly is deployed to the seabed using winches on the barge or a crane wire extending through the moonpool. Alternatively a surface vessel such as a barge can surface-tow modules or module assemblies behind or alongside. Surface-towing the module or assembly in these ways will cause fatigue to its structure, which could affect the reliability of the processing system. Indeed, there is a risk of the module or assembly being subjected to large slamming loads during transport across rough seas and a risk of injury to personnel on the barge during installation. Also, there is no backup solution in the event that the sea state deteriorates rapidly when the barge is far from a safe haven.

The modules disclosed in WO 2014/130320 have various regular flat-sided shapes to fit together like building blocks. Consequently, both the production/processing equipment and the structure of a module assembly are divided by the multiple interfaces between adjacent pairs of modules. These divisions introduce undesirable failure points in terms of structural strength and reliability. Thus, the risk of fatigue or other failure is heightened by the modular nature of the assembly.

Like U.S. Pat. No. 4,625,805 and WO 2011/037477 acknowledged above, WO 2014/130320 employs a multi-step piece-by-piece construction approach that involves installing seabed foundations and then installing a template on the foundations before modules or module assemblies are installed on the template. Then, in some instances, modules are assembled subsea on top of the template to complete the subsea plant. If modules are assembled subsea, dearly only individual modules and not the entire system can be tested onshore.

When an individual module of WO 2014/130320 is detached from the subsea installation and floated to the surface, all items of equipment on the module must be disconnected from the system even if only one of those items actually needs attention. Also, it is not just the items of equipment on the module that are separated from the system: as the module is structural, a part of the structure itself is separated from the system. This weakens the remaining structure and increases the risk of failure.

GB 2457784 describes a subsea seawater injection system positionable on the seabed. WO 01/71158 and US 2006/0118310 describe subsea systems installed on the seabed.

It is against this background that the invention has been devised.

The invention proposes a complete buoyant structure comprising an integrated protection structure and a complete production or processing system. The invention provides a protective, readily transportable structure on which the elements of a processing plant may be assembled and tested onshore or near shore. The structure transports the processing plant to a seabed installation site by mid-water towing and then protects the plant when on the seabed.

In one sense, the invention resides in a method for transporting and installing a subsea structure, which structure is a subsea processing centre comprising: a frame; production fluid processing equipment supported by the frame; and pipework in fluid communication with the production fluid processing equipment. The method comprises:

with the structure in water at a pre-towing location, ballasting to make the structure neutrally buoyant at or near to the water surface;

for towing to an installation location, controlledly flooding at least one ballast tank attached to the frame or incorporated into the frame, to an extent that the structure becomes negatively buoyant at a pre-determined towing depth;

towing the negatively-buoyant structure at the towing depth by the Controlled Depth Towing Method; and after towing to the installation location:

further flooding the or each ballast tank to lower the structure onto the seabed; and coupling at least one fluid transportation pipe to the pipework of the structure when the structure is on the seabed.

Conveniently, the equipment may be tested when the structure is in the water at the pre-towing location, or is onshore before being supported in the water.

Preferably, the method further comprises stabilising the structure when on the seabed by at least partially flooding hollow structural members of the frame.

The method may also comprise detaching at least one ballast tank from the structure when the structure is on the seabed and recovering that ballast tank to the surface.

Another advantageous possibility is to level the production fluid processing equipment supported by the frame by levelling adjustment of the equipment relative to the frame, in the event that the structure lands on an inclined or irregular seabed. Thus, a tilt-compensating mounting may act between the equipment and the frame for levelling the equipment relative to the frame.

The method of may further comprise recovering the structure from the seabed by: controlledly de-ballasting the or each ballast tank to the extent that the structure is slightly negatively buoyant at a pre-determined towing depth; towing the negatively-buoyant structure at the towing depth by the Controlled Depth Towing Method; and after towing, raising the structure to the surface.

This recovery technique may also be expressed independently within the inventive concept as a method of recovering a subsea structure from the seabed to the surface, comprising: controlledly de-ballasting at least one ballast tank attached to a frame of the structure or incorporated into the frame, to an extent that the structure is negatively buoyant at a pre-determined towing depth; lifting the structure from the seabed to the towing depth; towing the negatively-buoyant structure at the towing depth by the Controlled Depth Towing Method; and after towing, raising the structure to the surface.

Recovery of the structure may be preceded by attaching at least one ballast tank to the structure on the seabed.

In accordance with the invention, buoyancy and/or trim of the structure may be controlled before or during towing, by adjusting the buoyancy of the or each ballast tank or by controlledly flooding hollow structural members of the frame. As part of this control, gas may be injected under pressure to displace water from the or each ballast tank or from one or more hollow structural members of the frame.

Advantageously, trim may be adjusted by individually controlling buoyancy of ballast tanks distributed longitudinally and/or laterally with respect to the frame.

Buoyancy and/or trim are suitably controlled in response to signals from a depth sensor, an accelerometer, an inclinometer and/or a transponder carried by the structure.

Some embodiments of the invention envisage controlling yaw, roll or pitch of the structure during towing by moving hydrodynamic control surfaces that act on the structure.

The Inventive concept also embraces corresponding apparatus, namely a subsea processing centre that comprises: a towable frame; production fluid processing equipment supported by the frame; pipework in fluid communication with the production fluid processing equipment; at least one ballast tank attached to the frame or incorporated into the frame; flooding and filling valves for, respectively, flooding the or each ballast tank for ballasting or injecting gas into the or each ballast tank for de-ballasting; and a buoyancy control system that acts on the flooding and filling valves and is configured to control buoyancy and/or trim of the subsea processing centre before or during towing.

The or each ballast tank is preferably incorporated into a recoverable module that is separably attachable to the frame.

At least one pressurised gas vessel may be connected pneumatically to the or each ballast tank via the filing valve.

For adjustment of trim, ballast tanks are preferably distributed longitudinally and/or laterally with respect to the frame and the buoyancy control system is configured to adjust the buoyancy of each ballast tank individually.

The frame suitably comprises hollow structural members, in which case at least some of those members may be that are floodable under control of the buoyancy control system to control the buoyancy and/or trim of the structure.

Equipment supported by the frame may comprise any of: a pump, a valve, a flowmeter, a pressure sensor, a temperature sensor a liquid/gas separator or a water separator.

Thus, briefly, the invention provides a method for transporting and installing a heavy subsea structure such as a subsea processing centre for produced crude oil or natural gas. The invention also provides a apparatus in the form of a subsea processing centre that is adapted to perform the method. The method comprises: controlledly flooding at least one ballast tank attached to or incorporated into the structure, to the extent that the structure becomes negatively buoyant at a pre-determined towing depth; towing the negatively-buoyant structure at the towing depth by the Controlled Depth Towing Method (CDTM); and, after towing to the installation location, further flooding the ballast tank to lower the structure onto the seabed. At the seabed, a fluid transportation pipe of a subsea production installation may be coupled to pipework of the structure.

By applying the principle of variable buoyancy, the invention allows for the use of any existing qualified subsea equipment on a submersible platform provided by a buoyant subsea unit. On that platform, equipment providers can install their qualified units in a similar way to a regular offshore platform module. The unit provides deck space sufficient for a process plant to be fitted on top of the unit or preferably protected inside the unit. The unit suitably comprises a manifold system for import of well streams and for export of produced water for re-injection in an oil or gas reservoir.

Any regular processing units qualified for subsea use can be configured into a processing system that is suitable for the characteristics of a particular field. An onboard piping system connects the processing units together to form the processing system. The various units of the processing plant are surrounded by a lifting and transport frame or hull that interfaces with a vertical sliding system of the platform for installation and recovery of the individual processing units.

Processing units are connected to the onboard piping system using standardised ROV-operable connectors that enable release and recovery of the units during operation. Having assembled the processing system onto the platform, the complete system can be tested before towing to an installation site.

The hull structure of the unit balances the weight, and ballast tanks are used to trim the submerged unit as an underwater vessel in a manner similar to a submarine. Trimming the unit is performed by controlling variable ballast tanks by operating gas valves between gas 'quads'—being multiple pressurised cylinders stacked in a supporting protective frame—and the ballast tanks, and venting valves between the variable ballast tanks and the surrounding sea.

When trimmed slightly negative, the submerged processing unit is towed by the Controlled Depth Tow Method to field and installed by tug boats. At the seabed, the main ballast tanks are flooded to make the unit sufficiently stable. The unit will remain stable on the seabed until it is recovered by reversing the installation process. In this way, the system can be refurbished and/or modified before being reused at an alternative field location. This may be an important cost saving for many field developments, and particularly for marginal field developments.

For deepwater and/or ultra-deep water solutions, ballast tanks may be pre-pressurised to an elevated pressure to reduce the full effect of the external water depth.

The hull shape ensures protection of connectors for incoming or outgoing lines and provides the unit with overtrawlable features.

The engineering concept behind the invention is to use buoyancy, gravity and/or hydrodynamic forces in ways comparable to jackets, diving bells, pipeline bundles or buoyant riser systems, although hydrostatic and/or hydrodynamic control is more comparable to a submarine having variable buoyancy. A control system is used to trim the submerged unit by controlling valves in flooding tanks during trimming. This makes the vessel flexible enough to suit most fabrication yards and harbours, and allows the assembled system to be fully function-tested before it is deployed into the sea. The trim system will adjust the nearly fully submerged vessel before the tow or loadout to a heavy-lift vessel commences. In this way, differences between various configurations of processing equipment we accounted for.

By applying the CDTM, the functionality of the variable buoyancy control system does not need to be as complex as that used in submarines. In addition, the cost of a simple towing operation is dramatically lower than that of building a subsea processing plant at the seabed using a construction support vessel for regular lifting operations, or alternatively using a heavy-lift vessel capable of lifting a structure that may, for example, weigh 1500 to 3000 tons.

In order that the invention may be more readily understood, reference will now be made, by way of example, to the accompanying drawings in which.

Figure 1:
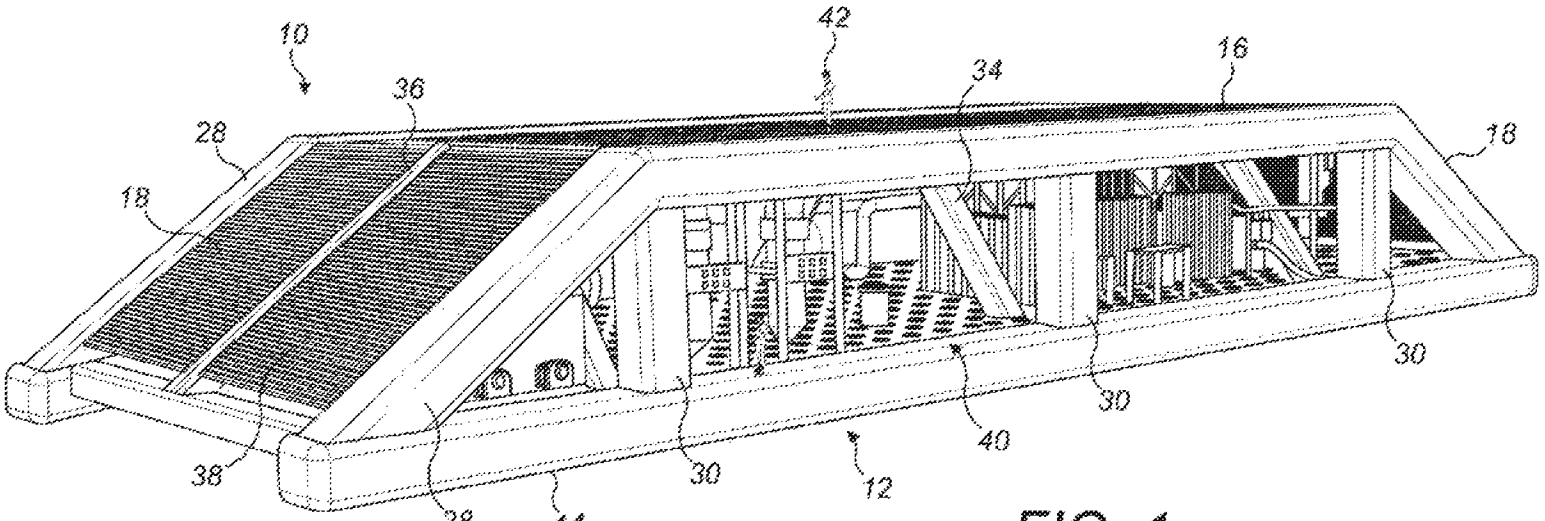
FIG. 1 is a perspective view of a subsea processing centre that may be transported and installed in accordance with the invention.
Figure 4:
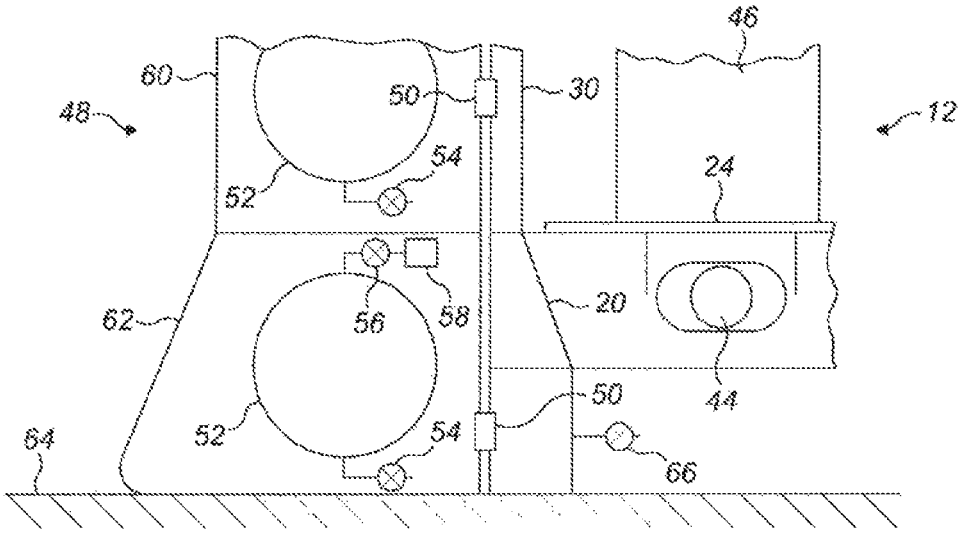
FIG. 4 is a schematic view in lateral cross-section of a detail of the subsea processing centre of FIG. 1, fitted with a buoyancy module 48 in accordance with the invention.
Figure 5:
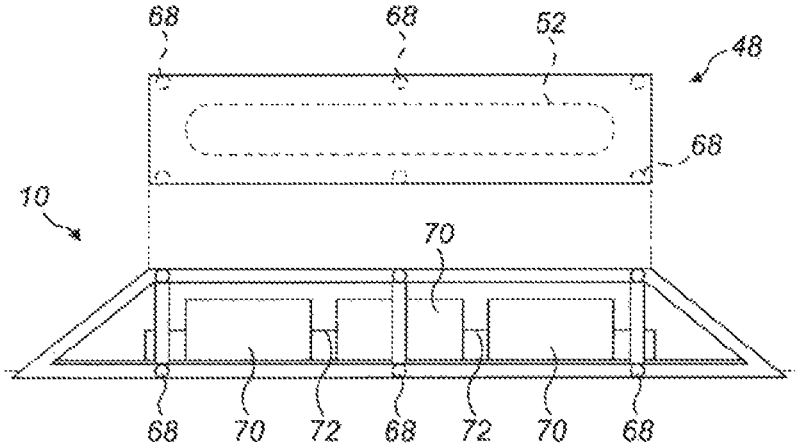
FIG. 5 is a schematic exploded side view of the subsea processing centre of FIG. 1 and the buoyancy module 48 of FIG. 4.
Figure 6:
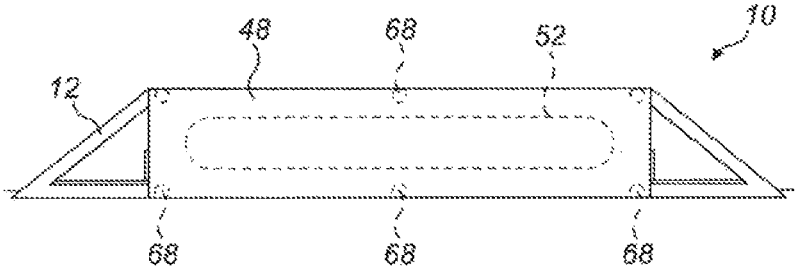
Figure 7:
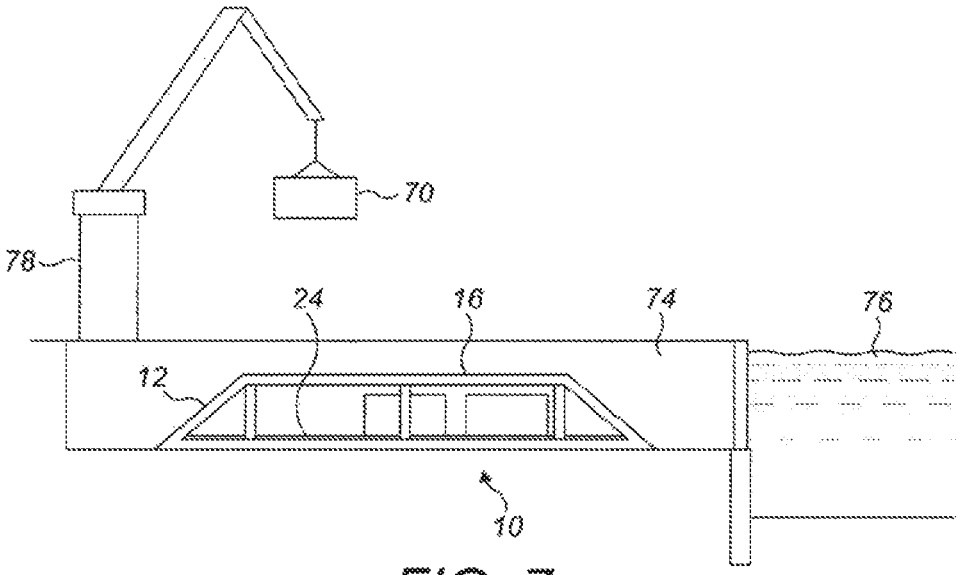
Figure 8:
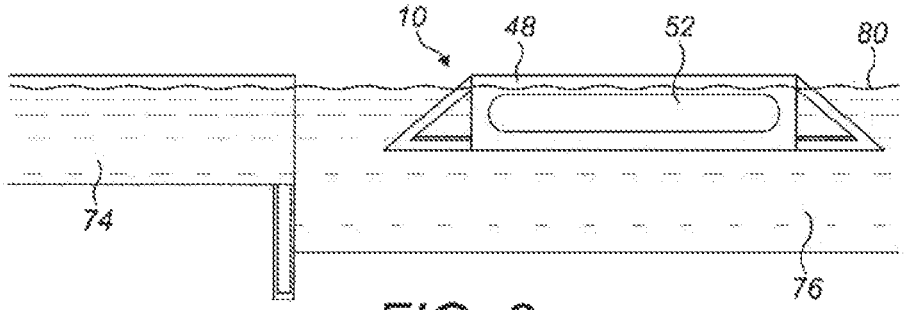
Figure 9:
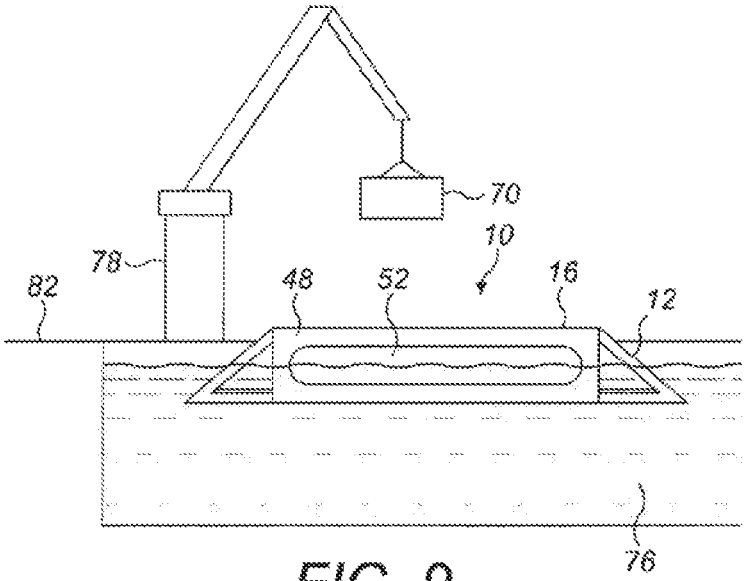
Figure 10A:
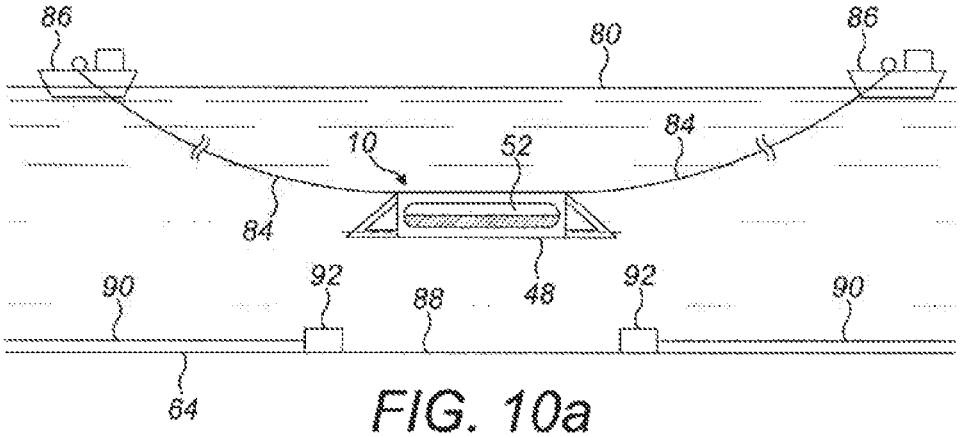
Figure 10B:
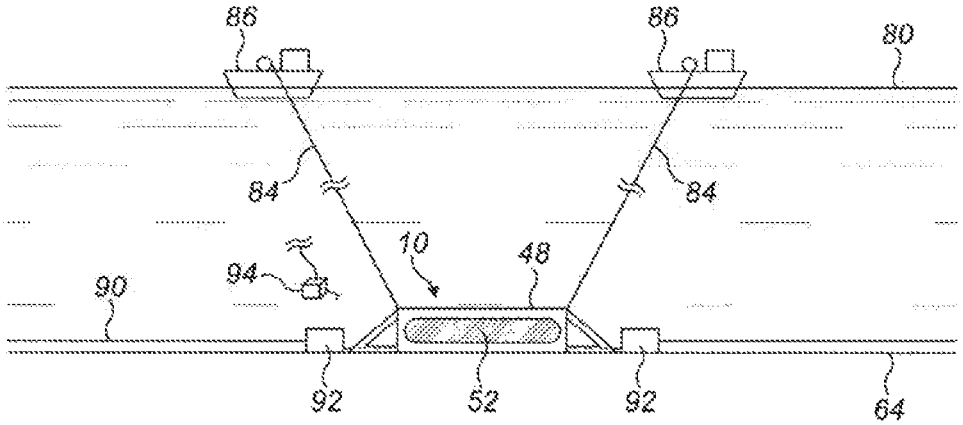
Figure 10C:
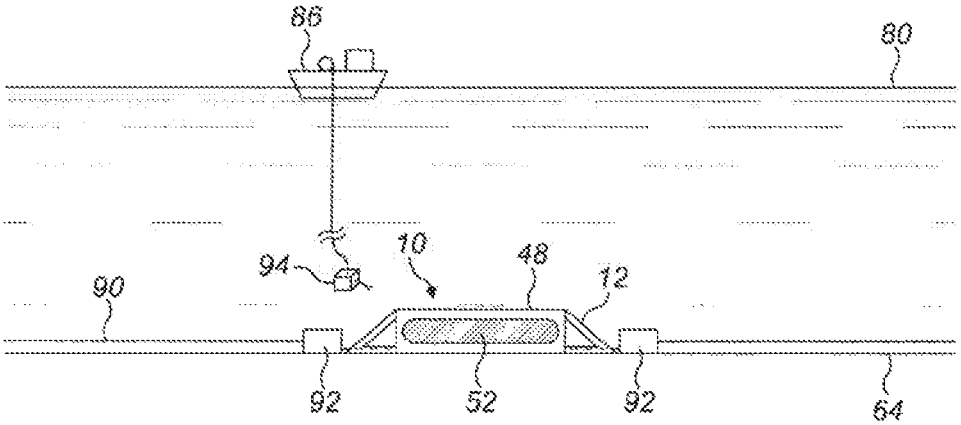

FIG. 6 corresponds to FIG. 5 but shows the buoyancy module 48 attached to the subsea processing centre;

FIG. 7 is a schematic side view showing the subsea processing centre of FIG. 1 being loaded with items of equipment while being assembled onshore;

FIG. 8 is a schematic side view following on from FIG. 7 and showing the now-assembled subsea processing centre having been fitted with the buoyancy module 48 of FIG. 4 and then lowered into an adjacent body of water;

FIG. 9 is a schematic side view showing the subsea processing centre of FIG. 1 fitted with the buoyancy module 48 of FIG. 4 and floating beside a shore facility, the subsea processing centre being loaded with items of equipment while assembly continues;

FIGS. 10*a*, 10*b* and 10*c* are a sequence of schematic side views in which FIG. 10*a* shows the use of the Controlled Depth Towing Method to tow the subsea processing centre of FIG. 1 fitted with the buoyancy module 48 of FIG. 4, followed by a lowering and installing step in FIG. 10*b* and a flooding and stabilising step in FIG. 10*c;*

Figure 11:
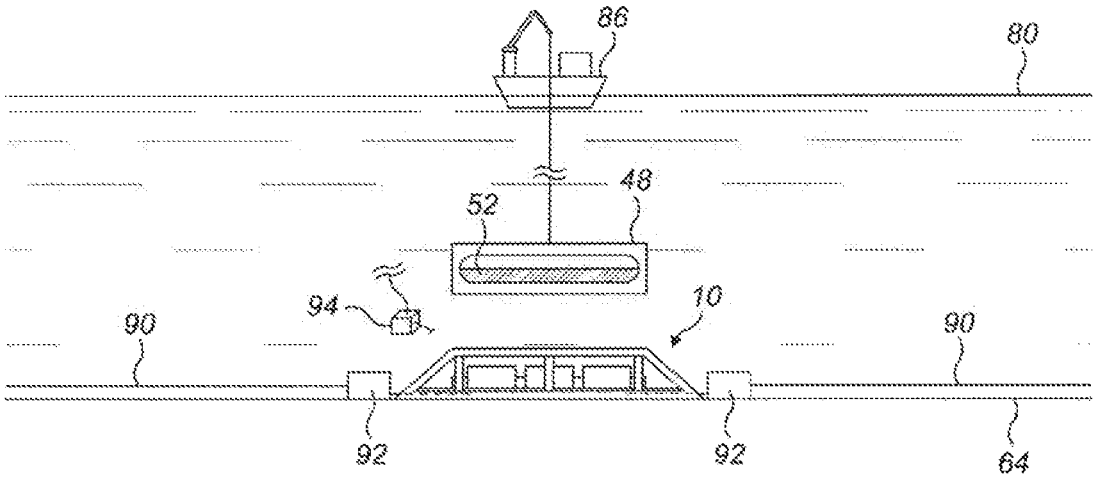
Figure 12:
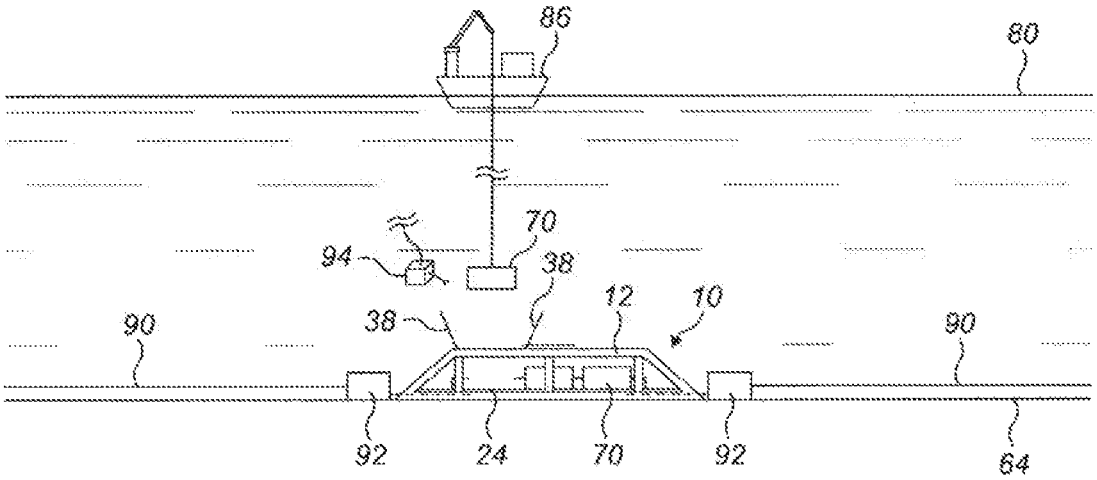
Figure 13:
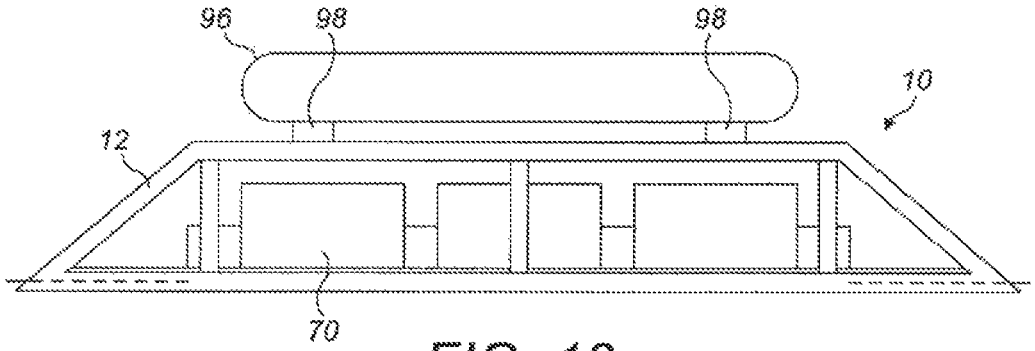
Figure 14:
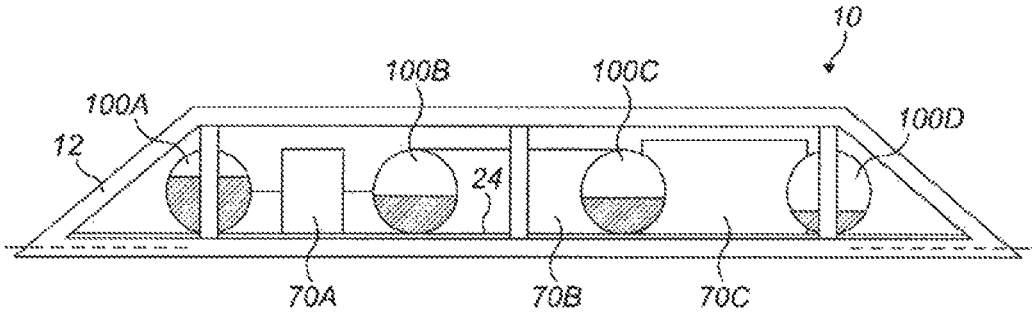
Figure 15:
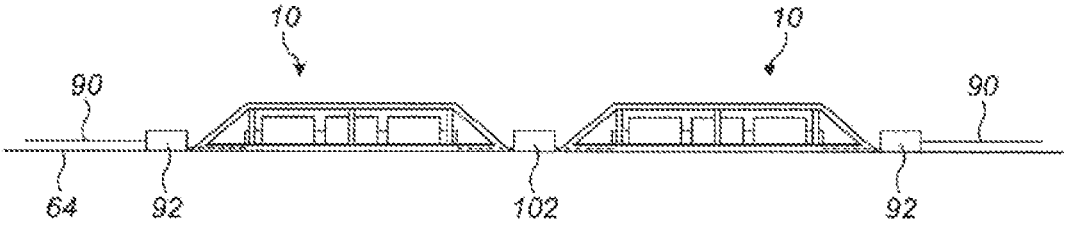
Figure 16A:
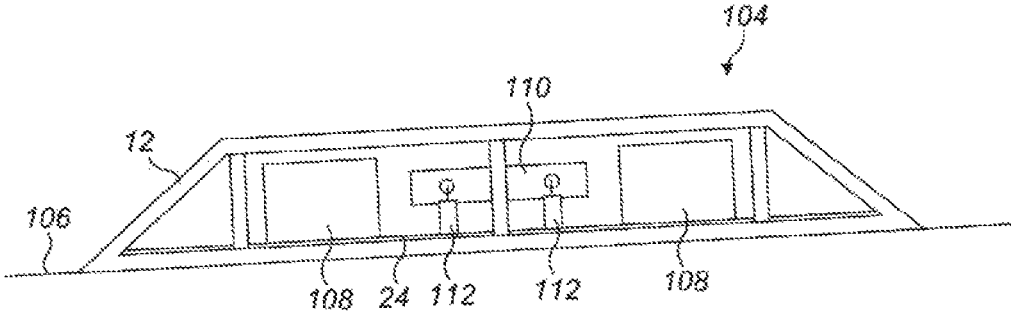
Figure 16B:
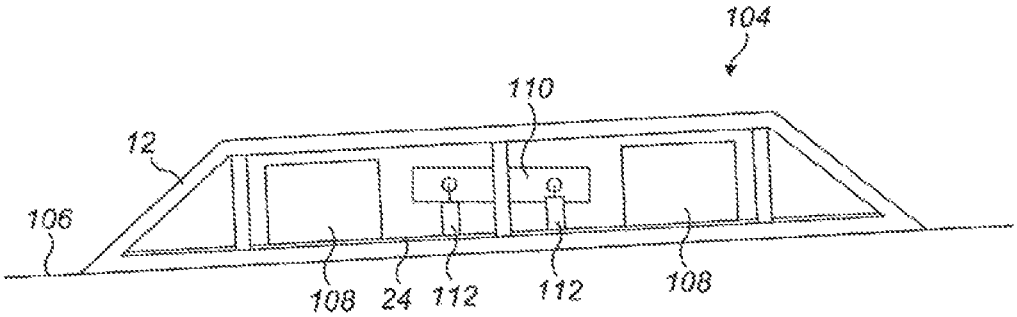
Figure 17:
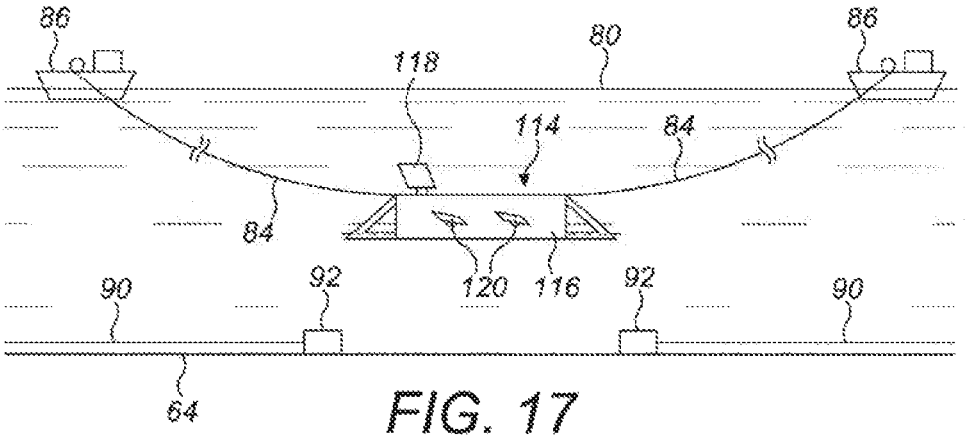

FIG. 11 is a schematic side view following on from FIG. 10*b* and showing the buoyancy module 48 now detached from the subsea processing centre and being recovered to the surface;

FIG. 12 is a schematic side view showing an item of equipment being lifted from the subsea processing centre for recovery to the surface for maintenance or replacement;

FIG. 13 is a schematic side view of a variant in which buoyancy modules 48 are attached to the top of the subsea processing centre of FIG. 1;

FIG. 14 is a schematic side view of another variant in which buoyancy modules 48 are integrated with the subsea processing centre of FIG. 1;

FIG. 15 is a schematic side view of showing how two or more subsea processing centres like that shown in FIG. 1 may be coupled to each other on the seabed to make a subsea factory;

FIGS. 16*a* and 16*b* are a sequence of schematic side views showing a subsea processing centre settled on the seabed at a substantial angle to the horizontal, these figures showing an item of equipment carried by the subsea processing centre before and after levelling respectively and FIG. 17 is a schematic side view corresponding to FIG. 10*a* but showing the subsea processing centre and the buoyancy module 48 fitted with a rudder and fins that are controllable to stabilise and control the path of the subsea processing centre during towing.

Figure 2:
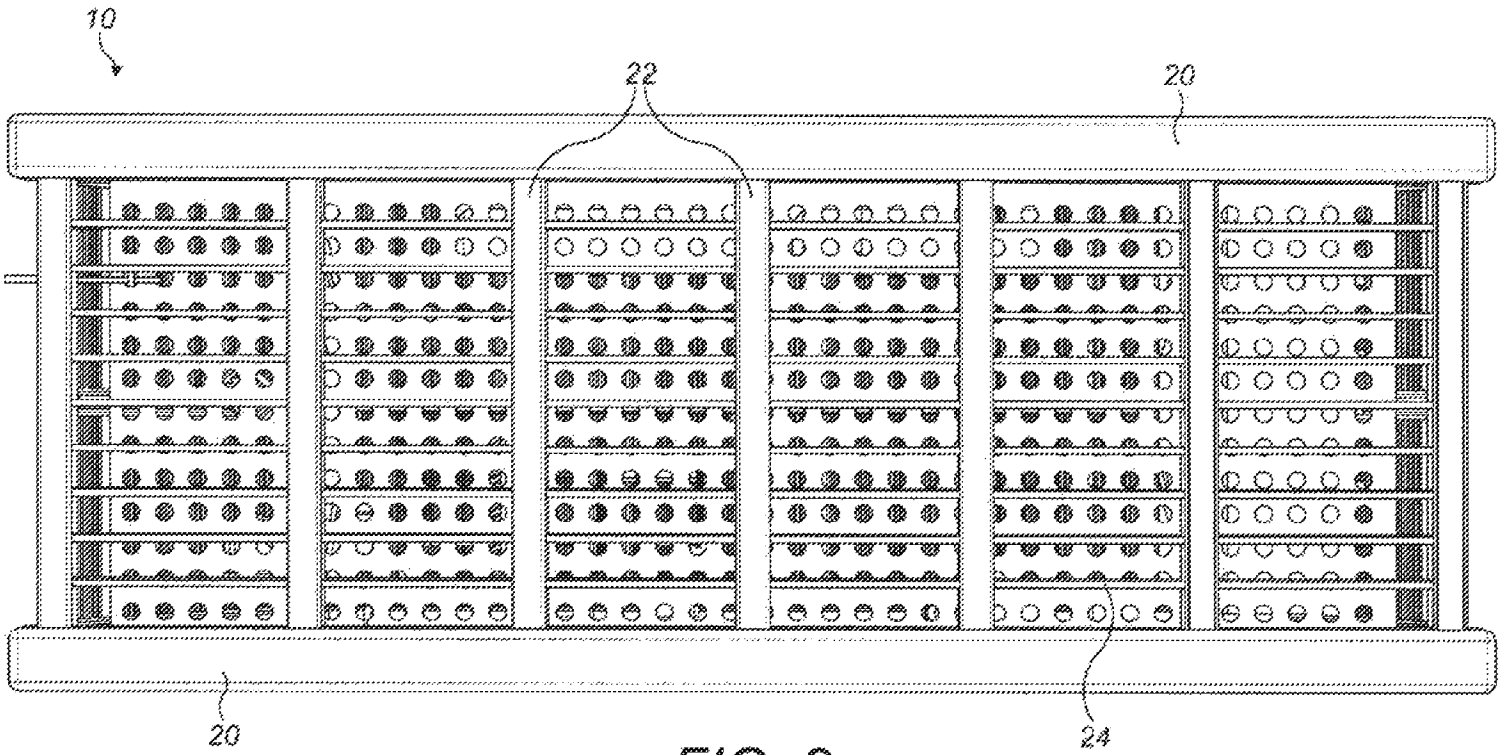
FIG. 2 is a bottom plan view of the subsea processing centre of FIG. 1.
Figure 3:
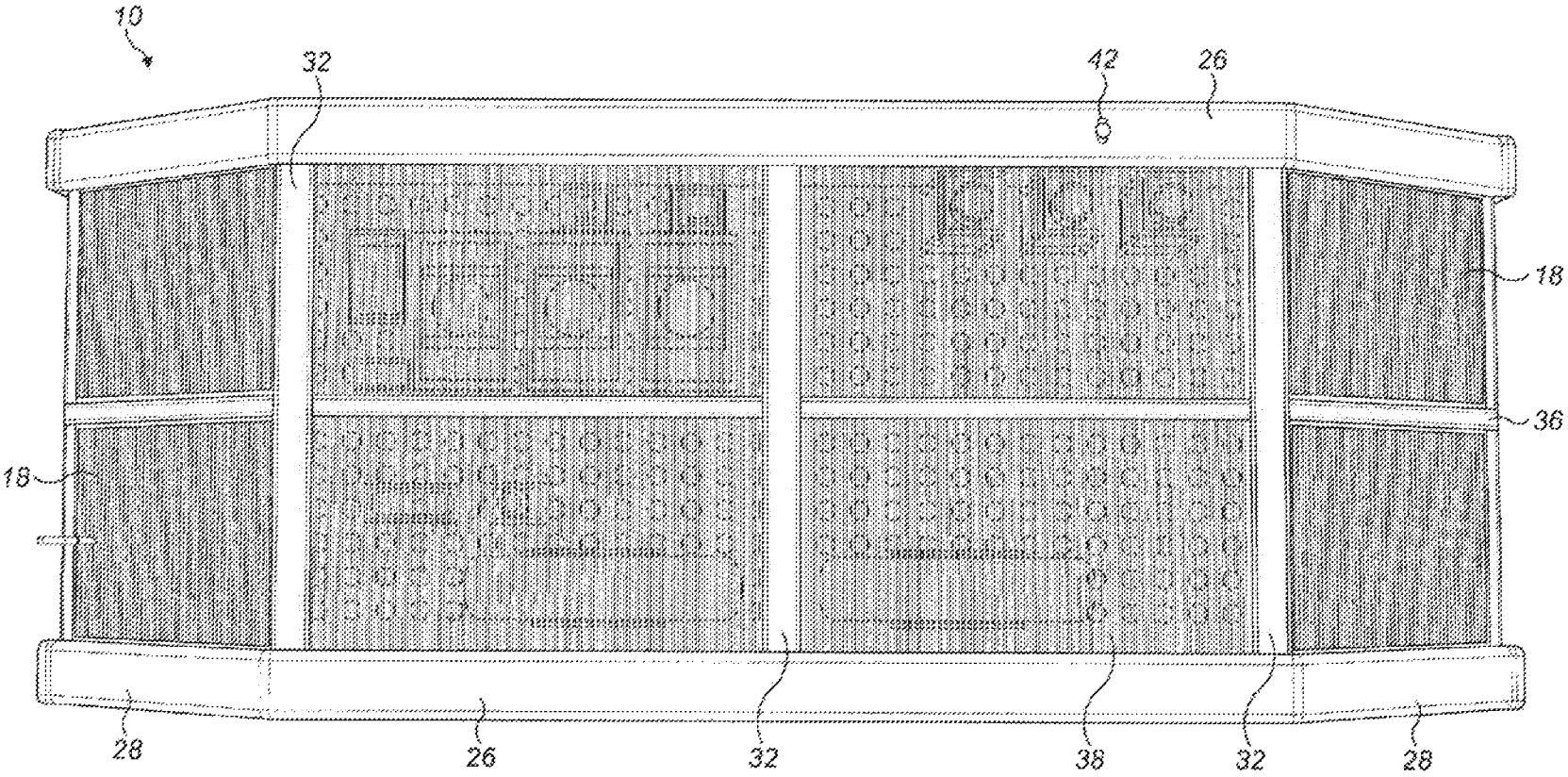
FIG. 3 is a top plan view of the subsea processing centre of FIG. 1.

Referring firstly to FIGS. 1 to 3 of the drawings, a subsea processing centre 10 comprises a box-section lattice frame 12 or hull fabricated from hollow structural members of welded steel construction. The discrete rigid frame 12 has a generally flat base 14 and a generally flat top 16 that lie spaced apart in parallel planes. The top 16 and the base 14 of the frame 12 have the same width, whereas the top 16 is shorter than the base 14 and is centred longitudinally with respect to the base 14. Thus, the frame 12 is shaped as a regular trapezium in longitudinal section or in side view. Downwardly-tapering wedge-shaped ends 18 extend from the ends of the top 16 to the ends of the base 14.

As best seen from underneath as in FIG. 2, the base 14 of the frame 12 is an oblong ladder platform comprising a parallel pair of lower longitudinal beams 20 joined by an array of spaced parallel lower cross-members 22 that extend orthogonally with respect to the lower longitudinal beams 20. The lower cross-members 22 support perforated load-bearing panels that define a deck 24 within the frame 12. The deck 24 lies in a horizontal plane when the base 14 lies on a horizontal seabed in use.

FIG. 3 shows that the top 16 of the frame 12 comprises relatively short upper longitudinal beams 26 that lie parallel to the relatively long lower longitudinal beams 20. The upper longitudinal beams 26 are spaced from the lower longitudinal beams 20 by inclined buttresses 28 at each end and by an array of spaced parallel upright columns 30. The inclination of the buttresses 28 defines the inclination of the wedge-shaped ends 18.

The upper longitudinal beams 26 are joined by an array of spaced parallel upper cross-members 32 that extend orthogonally with respect to the upper longitudinal beams 26. Each of the upper cross-members 32 is aligned with a buttress 28 and/or with a column 30 and is supported by inclined braces 34 that splay downwardly to join the lower longitudinal beams 20. A central longitudinal spine member 36 joins the upper cross-members 32 and extends down the wedge-shaped ends 18 to join the outermost lower cross-members 22 at the ends of the frame 12.

Oblong grille panels 38 close the spaces between the upper longitudinal beams 26, the upper cross-members 32 and the central spine member 36 on the top of the frame 12. Additional oblong grille panels 38 close the spaces between the outermost upper cross-members 32, the outermost lower cross-members 22 and the central spine member 36 at the ends of the frame 12.

The frame 12 is arranged to give protection against trawling when installed on the seabed. In particular, the subsea processing centre 10 is overtrawlable by virtue of the wedge-shaped ends 18 and the grille panels 38 that fit substantially flush to the frame 12.

The subsea processing centre 10 is designed to house and support equipment generally indicated at 40 on the deck 24 and within the frame 12. The equipment 40 comprises various items of processing apparatus for processing production fluid flowing from a subsea oil or gas well, or for processing other fluids used in production. In general, the equipment that can be anything that interacts with the fluid flowing through pipework of the subsea processing centre 10, including production fluid processing apparatus.

The equipment 40 also comprises other items of apparatus for powering and controlling the processing apparatus, and optionally also for controlling the buoyancy and stability of the subsea processing centre 10 when it is being towed underwater. Other equipment 40 may be included for subsea power generation, transmission or distribution.

Typically, apparatus for processing production fluid will comprise at least a water separator for removing water from the production fluid. More generally, processing apparatus housed by the subsea processing centre 10 may perform a variety of tasks including any of: gas/liquid separation; subsea boosting; subsea gas compression; gas treatment including dewpoint control; pipeline heating; seawater treatment and injection; and/or injection of chemicals. Chemicals may also be stored in the subsea processing centre 10, ready for injection.

The grille panels 38 may be moved or removed for access from above to install or remove individual items of equipment 40 supported by the deck 24 within the frame 12. The sides of the frame 12 may be left open as shown, providing access to the equipment 40 for routine maintenance and other operations by subsea intervention, for example using an ROV.

As a non-limiting example, the frame 12 shown in FIGS. 1 to 3 is approximately 10 m high and 80 m long and weighs approximately 1500 to 3000 tons when fitted with typical equipment. Workers 42 are shown on the frame 12 in FIGS. 1 and 3 to illustrate its very large scale.

Turning now to FIG. 4 of the drawings, this shows a detail of the frame 12 of the subsea processing centre 10. This detail view is a lateral or transverse cross-section showing a junction between a lower longitudinal beam 20, a lower cross-member 22 intersecting the lower longitudinal beam 20, a panel of the deck 24 supported by the lower cross-member 22 and a column 30 upstanding from the lower longitudinal beam outboard of the deck 24.

A pipeline 44 for production fluid extends through the lower cross-member 22 generally parallel to the lower longitudinal beam 20. Production fluid in the pipeline 40 may be processed or otherwise modified by one or more items of processing apparatus shown here schematically as a box 40 supported by the deck 24.

A buoyancy module 48 is attached to a side of the subsea processing centre 10 outboard of the frame 12. Rigid attachment of the buoyancy module 48 to the frame 12 is effected by fastenings 50 defining attachment points. Preferably the fastenings 50 are latches that are releasable remotely or by subsea intervention, for example using an ROV, to allow the buoyancy module 48 to be separated from the frame 12. A similar buoyancy module 48 is similarly attached to the other side of the subsea processing centre 10 but is not shown in FIG. 4.

Each buoyancy module 48 comprises one or more balast tanks 52. The ballast tanks 52 are suitably of a rigid polymer material such as fibre-reinforced plastics. Each ballast tank 52 has a flooding valve 54 for admitting water as air or other gas is expelled from the tank 52 through a suitable vent or outlet port. Each ballast tank 52 also has a filing valve 56 for admitting high-pressure air or other gas into the tank from a suitable source 58, either to displace water for increasing buoyancy or to resist collapse of the tank 52 under hydrostatic pressure.

The flooding valve 54 and a valve controlling ingress of air or other gas into the filing valve 56 may be operable remotely or by subsea intervention, for example using an ROV. Preferably, those valves are controlled by a buoyancy control system provided onboard the subsea processing centre 10 or on a surface vessel that tows the subsea processing centre 10 to an installation site, as will be explained. The buoyancy control system suitably comprises a stability module that takes input from a depth sensor, an accelerometer, an inclinometer and/or a transponder, to adjust the buoyancy of the ballast tank preferably automatically.

The buoyancy module 48 comprises a hollow free-flooding structure 60 that surrounds and supports the ballast tanks 52. The structure 60 of the buoyancy module 48 is suitably skinned with glass-reinforced plastics. The lower outer wall 62 of that structure 60 flares downwardly and outwardly to the seabed 64 as shown in FIG. 4 to improve the overtrawling qualities of the subsea processing centre 10 when the buoyancy module 48 is attached to it.

The ballast tanks 52 are preferably non-structural in relation to the frame 12 as shown. However, any or all of the longitudinal beams 20, 26, the cross-members 22, 32, the buttresses 28, the braces 34 and the columns 30 of the frame 12 may define closed chambers. Air trapped in those chambers adds buoyancy to the frame 12 when required, as upon launching the subsea processing centre 10. When less buoyancy is required, as upon lowering or landing the frame 12 on the seabed 64 for example, the trapped air may be allowed to escape as water floods in. For this purpose, a flooding valve 66 is shown in FIG. 4 on the lower longitudinal beam 20, by way of example. The flooding valve 66 may be operable remotely or by subsea intervention, for example using an ROV.

In general, any of the hollow members of the frame 12 may have similar flooding valves or may be interconnected for fluid communication to fill or to flood together. It is also possible for any of the hollow frame members to have similar filling valves for admitting high-pressure air or other gas to increase buoyancy or to resist collapse under hydrostatic pressure.

In practice, the source 58 of the high-pressure air or other gas used internally to pressurise a ballast tank 52 or a hollow frame 12 member may be a downline from the surface or an onboard gas supply carried by the subsea processing centre 10. Gas may be supplied by compressors or by quads.

The box 46 identified in FIG. 4 as an item of processing apparatus could instead represent apparatus for powering and controlling processing of production fluid, for storing chemicals or for generating, transmitting or distributing power. That box 46 could also represent the aforementioned buoyancy control system for controlling the buoyancy and stability of the subsea processing centre 10 when under tow, thus being connected to the various flooding valves and filing valves of the ballast tanks 52 and of the hollow frame members.

FIGS. 5, 6, 8, 9, 10*a*. 10*b*, 10*c* and 11 are schematic side views that show the subsea processing centre 10 in combination with a simplified example of the buoyancy module 48 shown in FIG. 4. In this example, the buoyancy module 48 is arranged to extend along most of the open side of the frame 12 of the subsea processing centre 10. In each case, a single ballast tank 52 is shown in the buoyancy module 48 for ease of illustration.

Cross-hatch shading is used to show where the ballast tank 52 contains mainly air to impart strongly positive buoyancy to the subsea processing centre 10 to which the buoyancy module 48 is attached (no shading); mainly water to impart strongly negative buoyancy to the subsea processing centre 10 (full shading); or is partially filled with water and with air to impart near-neutral or slightly negative buoyancy to the subsea processing centre 10 (half shading).

FIG. 5 is an exploded side view showing the relationship between the buoyancy module 48 and the subsea processing centre 10. Fastenings 68 defining attachment points for attaching the buoyancy module 48 to the subsea processing centre 10 are spaced around the side of the frame 12. Complementary fastenings 68 defining corresponding attachment points are spaced around the other side of the buoyancy module 48 and are seen here in dotted lines. FIG. 6 shows the buoyancy module 48 attached to the subsea processing centre 10 via the fastenings 68.

FIG. 5 shows boxes 70 representing items of equipment such as processing apparatus, control apparatus and power apparatus distributed on the deck 24 of the subsea processing centre 10. Those items of equipment 70 are connected by pipework 72, which may include a connector hub or other provision for the connection and disconnection of additional production fluid service modules. The pipework 72 extends to the ends of the subsea processing centre 10 for connection, in use, to a flowline on the seabed that carries production fluids. Other fluid connections may be made between the subsea processing centre 10 and other subsea pipes such as water injection pipes, as well as power and data connections between the subsea processing centre 10 and other subsea systems. Connections could also be made at the open sides of the subsea processing centre 10.

FIGS. 7 and 8 shows a shore installation comprising a dry dock 74 beside a body of water 76. In FIG. 7, the subsea processing centre 10 is being assembled onshore in the dry dock 74 before being fitted with buoyancy modules 48. When the buoyancy modules 48 have been fitted, the subsea processing centre 10 is ready to be floated into the water 76 after the dry dock 74 has been flooded and opened to the sea as shown in FIG. 8.

Specifically, FIG. 7 shows the subsea processing centre 10 in the dry dock 74 in the final stages of assembly by a quayside crane 78. The crane 78 is shown here placing items of equipment 70 onto the deck 24 of the subsea processing centre 10, in bays beneath spaces in the top 16 of the frame 12 before the grille panels 38 are fixed to the frame 12. A known vertical sliding system may be employed to guide the equipment 70 into the correct location during lowering.

A dry dock is not the only assembly and launching option. In principle, it would be possible instead to assemble and then to lift or to launch the assembled subsea processing centre 10 from the quayside or a slipway into the water 76.

Subsequently, the crane 78 will lift buoyancy modules 48 onto the frame 12. FIG. 8 shows the subsea processing centre 10 fitted with buoyancy modules 48 whose ballast tanks 52 are filed with air for positive buoyancy. The subsea processing centre 10 floats on the surface 80 of the water 76, largely submerged but with a shallow draft allowing it to be towed through shallow water away from the shore.

FIG. 9 shows that at least some assembly or fit-out operations may be performed on the subsea processing centre 10 after it has been floated in the water 76. The quayside crane 78 is shown here placing items of equipment 70 through the open top 16 of the frame 12 of the subsea processing centre 10 when moored beside a quay 82.

Advantageously, testing the equipment and systems of the subsea processing centre 10 may be performed on-shore as in FIG. 7 or when moored beside the quay 82 as in FIG. 9. The subsea processing centre 10 is then ready for towing to an installation site by the Controlled Depth Towing Method or 'CDTM' as described in EP 0069446 and in a technical paper OTC 6430 (OTC Conference, 1990). In this respect, reference is now made to FIGS. 10*a*, 10*b* and 10*c* of the accompanying drawings.

The CDTM principle involves transportation of the prefabricated and fully-tested subsea processing centre 10 suspended on towing lines 84 between surface vessels 86 fore and aft as shown in FIG. 10*a*. Unlike a huge installation barge, these may be relatively small and inexpensive vessels 86 equipped with winches, such as tugs.

As described in EP 0069446 and OTC 6430, CDTM is applied to the installation of very long pipeline bundles. Drag chains are used for ballasting and depth control. Such chains are unnecessary or, at most, optional in the CDTM proposed by the present invention, which instead prefers fine control of ballasting tanks to control the depth and trim of the subsea processing unit 10 during towing.

As the shading in FIG. 10*a* shows, the ballast tanks 52 of the buoyancy modules 48 are partially flooded under the control of control systems on the subsea processing centre 10 or on a surface vessel 86. This makes the subsea processing centre 10 slightly negatively buoyant at a predetermined mid-water towing depth, which is preferably at least fifty metres. Modest tension in the towing lines 84 under the drag forces of towing balances the slight negative buoyancy of the subsea processing centre 10 to maintain the desired depth, assisted by ongoing control of the buoyancy of the ballast tanks 52. In practice, separate ballast tanks will be distributed along the length of the subsea processing centre 10 to enable adjustment of its trim.

At the desired towing depth, the subsea processing centre 10 is held safely clear of the seabed 64 but also beneath the influence of wave action near the surface 80. Even if the sea state deteriorates dramatically during the tow, the subsea processing centre 10 can be lowered to the seabed 64 to await better weather conditions.

FIG. 10*a* shows the subsea processing centre 10 having just arrived at the installation location, directly above a predetermined gap 88 between pre-laid elements of a subsea production system. Those elements comprise fluid transportation pipes 90 that end in terminal connectors 92 facing each other across the gap 88.

When the subsea processing centre 10 reaches the installation site, it is lowered toward the seabed 64 by more fully flooding the ballast tanks 52 of the buoyancy modules 48 to increase its negative buoyancy. Meanwhile, the towing lines 84 are paid out from the surface vessels 86. The subsea processing centre 10 then settles on the seabed 64 in the predetermined gap 88 as shown in FIG. 10*b*, with its position relative to the gap 88 being monitored by an ROV 94. At least one of the surface vessels 86 is then free to leave the site to be available for other tasks.

By dark shading, FIG. 10*c* shows hollow members of the frame 12 of the subsea processing centre 10 having been flooded after landing on the seabed 64 to stabilise the subsea processing centre 10. In this example, the remaining surface vessel 86 provides assistance via the ROV 94 for flooding the hollow frame members and/or for making tie-in connections between on-board pipework of the subsea processing centre and the pre-laid elements 90, 92 of the subsea production system. The static weight of the frame 12 after flooding provides sufficient inertia, friction and stability for the subsea processing centre 10 to be anchored to the seabed 64 without the need for a template to be pre-installed on the seabed 64.

FIG. 11 shows an optional subsequent operation, namely disconnecting the buoyancy modules 48 from the subsea processing centre 10 and recovering those modules 48 to the surface 80 for possible re-use. Here, optionally, air has been pumped into the ballast tanks 52 to establish slightly negative buoyancy. The air de-ballasts the ballast tanks 52 by displacing water in a controlled manner. De-ballasting in this way reduces the apparent weight of the buoyancy module 48 to ease lifting by a crane or winch of a surface vessel 86. The buoyancy modules 48 may be detached from the subsea processing centre 10 automatically or with subsea intervention, in this example provided by an ROV 94.

FIG. 12 shows how the subsea processing centre 10 may be serviced while remaining on the seabed 64. Here, an ROV 94 has opened grille panels 38 that normally close the top 16 of the subsea processing centre 10 to provide access to equipment in bays on the deck 24 beneath. A surface vessel 86 is using a crane to lift an item of equipment 70 to the surface. In this way, individual items of equipment 70 such as pumps may be isolated and swapped out using well-known techniques. The aforementioned vertical sliding system suitably guides the replacement equipment 70 into the correct location on the deck 24 during lowering.

Notably, the structural integrity of the subsea processing centre 10 relies upon the frame 12 and so is unaffected by removing items of equipment 70 supported by that frame 12, unlike modular systems of the prior art that divide not just their equipment but also their structure between modules.

FIGS. 13 and 14 show other possible locations for buoyancy modules or ballast tanks. FIG. 13 shows a ballast tank 96 attached to the top of the frame 12 of the subsea processing centre 10 by fastenings 98. Those fastenings 98 may be releasable latches if it is desired to detach the ballast tank 96 for recovery to the surface after the subsea processing centre 10 has been installed. Otherwise, the ballast tank 96 may be left permanently attached to the frame 12 like the ballast tanks 100A to 1000 shown in FIG. 14, which are housed within the frame 12.

Longitudinally-distributed ballast tanks 100A to 100D like those shown in FIG. 14 may be incorporated into the subsea processing centre 10 as shown in FIG. 14 or removably attached to the subsea processing centre 10, either directly or as part of buoyancy modules 48 as described previously. FIG. 14 is used to show a further benefit of distributed ballast tanks 100A to 100D under individual selective control, namely to adjust the trim of the subsea processing centre 10 to suit different configurations of equipment 70 on the deck 24.

To illustrate this principle, the subsea processing centre 10 of FIG. 14 carries three types of equipment 70 from one end to the other—namely, from left to right as illustrated: relatively small and light equipment 70A: medium-sized equipment 706 of medium weight; and relatively large and heavy equipment 70C. To balance the subsea processing centre 10 against these different weights acting on the respective ends, the buoyancy of the balast tanks 100A to 100D is adjusted individually. Thus, the ballast tank 100A adjacent to the light equipment 70A contains more water than air whereas the ballast tank 1000 adjacent to the heavy equipment 70C contains more air than water. The intermediate ballast tanks 1008 and 100C contain roughly equal amounts of air and water.

It will be apparent to the skilled reader that ballast tanks may similarly be distributed laterally across the width of the subsea processing centre 10 to compensate for weight imbalances of equipment in the widthwise direction. It would also be possible to adjust buoyancy of individual ballast tanks continuously and dynamically during towing to respond to dynamic forces acting on the subsea processing centre 10, particularly such forces as may induce oscillation in pitch or roll. Similarly, different hollow members of the frame 12 may also be flooded with water or emptied of water individually or selectively to adjust trim or to respond to dynamic forces acting on the subsea processing centre 10.

Another option with distributed ballast tanks is to choose differently-sized balast tanks for different locations, to suit the expected weight distribution arising from a particular configuration of the equipment on the deck.

It is possible to combine two or more subsea processing centres 10 of the invention to make a larger or more capable subsea factory with additional processing or production functionality. In this respect, FIG. 15 shows two subsea processing centres 10 coupled to each other end-to-end on the seabed 64 via an intermediate connector 102, filling a predetermined gap between pre-laid fluid transportation pipes 90 and terminal connectors 92 of a subsea production system.

FIGS. 18*a* and 16*b* show that once a subsea processing centre 10 is settled on the seabed, the orientation of an item or module of equipment with respect to the inclination of the frame 12 may be modified. For example, a vertical separator vessel needs to be substantially vertical, even if the subsea processing centre 10 that supports it is not substantially horizontal when settled on the seabed.

In FIGS. 16*a* and 16*b*, a subsea processing centre 104 is shown landed on a substantially inclined seabed 106. The frame 12 of the subsea processing centre 104 contains three items of equipment in these simplified schematic views.

Two of the items of equipment 108 shown in FIGS. 16*a* and 16*b* can tolerate being off vertical or off horizontal. Consequently, those items 108 are fixed immovably to the deck 24 of the subsea processing centre 104.

Conversely, the third item of equipment 110 shown in FIGS. 16*e* and 16*b* must be kept substantially vertical or horizontal during operation. To allow this even if the subsea processing centre 10 ends up resting at an angle to the horizontal, that equipment 110 can pivot or float relative to the deck 24. More specifically, a tilt-compensating mounting is provided between the deck 24 and the equipment 110. The equipment 110 may be connected to the pipework of the subsea processing centre 104 by flexible or pivotably-jointed piping.

Those skilled in the art will know of various active or passive tilt-compensating or levelling mountings such as gimbals. As a simple example of such a mounting, FIGS. 16*a* and 16*b* show the equipment 110 supported by longitudinally-spaced upright actuators 112 whose extensions can be adjusted individually to level the equipment 110 about a transverse axis as shown in FIG. 18*b*. Whilst not shown, laterally-spaced actuators could be provided similarly to level the equipment 110 about a longitudinal axis.

Finally, FIG. 17 shows a subsea processing centre 114 fitted with a buoyancy module 116 and being transported during a CDTM operation like that shown in FIG. 10*a*. Here, the subsea processing centre 114 is fitted with an upright rudder 118 and the buoyancy module 116 is fitted with laterally-extending fins, wings or planes 120. These various hydrodynamic control surfaces 118, 120 are pivotable under computer control to stabilise, trim and control the path of the subsea processing centre 114 during towing.

Many other variations are possible within the inventive concept. For example, whilst FIG. 12 shows how the subsea processing centre can remain on the seabed for several years while being serviced from the surface, it may eventually need to be recovered from the seabed to the surface. For this purpose, once the subsea processing centre has been disconnected from the subsea production system and buoyancy modules have been reattached to the subsea processing centre if necessary, the or each ballast tank of the buoyancy modules is de-ballasted by displacing water with pressurised gas in a controlled manner. If flooded, hollow frame members of the subsea processing centre may similarly be de-ballasted. De-ballasting in this way reduces the apparent weight of the subsea processing centre for lifting by a crane or winch of a surface vessel.

If a subsea processing centre is to be scrapped and recycled after use, it may simply be raised to the surface and towed from there to a shore facility. Some damage or fatigue of the subsea processing centre caused by wave action will not then be a concern. However if the subsea processing centre is to be refurbished and reused, a reverse CDTM process may be employed. In that case, injection of de-ballasting gas is controlled to achieve slightly neutral buoyancy at a desired towing depth, whereupon CDTM towing takes place in the water column with controlled depth and buoyancy. Finally, the subsea processing centre is raised to the surface in shallower, sheltered water near shore to be refurbished for reuse. In essence, this is the reverse of the process shown in FIGS. 9 to 10*c*.

Yet more variations are possible within the inventive concept. For example, ballast tanks or any of the hollow members of the frame could be pre-pressurised at the surface to above-ambient pressure. This reduces gas consumption when increasing buoyancy in deeper water and increases the resistance of the ballast tanks or hollow members to collapse under hydrostatic pressure.

It would, of course, be possible to lay other elements of a subsea production system after landing the subsea processing centre, hence avoiding the requirement to aim the subsea processing centre into a predetermined gap between pre-laid elements of the subsea production system.

The invention claimed is:

1. A subsea processing center, comprising: a towable frame; production fluid processing equipment supported by the frame; pipework in fluid communication with the production fluid processing equipment; at least one ballast tank attached to the frame or incorporated into the frame; flooding and filling valves for, respectively, flooding the or each ballast tank for ballasting or injecting gas into the or each ballast tank for de-ballasting; a buoyancy control system that acts on the flooding and filling valves and is configured to control buoyancy and/or trim of the frame during towing; and a tilt-compensating mounting acting between the production fluid processing equipment and the frame for leveling the production fluid processing equipment relative to the frame.

2. The subsea processing center of claim 1, wherein the or each ballast tank is incorporated into a recoverable module that is separably attachable to the frame.

3. The subsea processing center of claim 1, further comprising at least one pressurised gas vessel pneumatically connected to the or each ballast tank via the filling valve.

4. The subsea processing center of claim 1, wherein ballast tanks are distributed longitudinally and/or laterally with respect to the frame and the buoyancy control system is configured to adjust the buoyancy of each ballast tank individually.

5. The subsea processing center of claim 1, wherein the frame comprises hollow structural members that are floodable under control of the buoyancy control system to control the buoyancy and/or trim of the frame.

6. The subsea processing center of claim 1, wherein the buoyancy control system is responsive to an onboard depth sensor, accelerometer, inclinometer and/or transponder.

7. The subsea processing center of claim 1, further comprising hydrodynamic control surfaces that are movable to control yaw, roll or pitch during towing.

8. The subsea processing center of claim 1, wherein production fluid processing equipment supported by the frame comprises any of: a pump, a valve, a flowmeter, a pressure sensor, a temperature sensor a liquid/gas separator or a water separator.

* * * * *